United States Patent [19]

Natiw

[11] Patent Number: 4,681,555

[45] Date of Patent: Jul. 21, 1987

[54] PUPPET OR DOLL HAVING STRUCTURE PROVIDED BY STUFFING

[76] Inventor: Edna C. Natiw, 15718 Levan, Livonia, Mich. 48154

[21] Appl. No.: 855,744

[22] Filed: Apr. 25, 1986

[51] Int. Cl.[4] ..... A63H 3/14

[52] U.S. Cl. ..... 446/327; 446/372

[58] Field of Search ..... 446/327, 369, 372

[56] References Cited

U.S. PATENT DOCUMENTS

| | | | |
|---|---|---|---|
| D. 167,265 | 7/1952 | Keane | D34/3 |
| 1,442,761 | 1/1923 | Beach | 446/372 |
| 1,583,408 | 5/1926 | Mackay | 446/372 |
| 1,790,872 | 2/1931 | McBee | 446/372 |
| 1,948,803 | 2/1934 | Sherrill | 46/40 |
| 2,391,131 | 12/1945 | Clark | 446/372 |
| 2,433,555 | 12/1947 | Hulse | 46/151 |
| 2,483,325 | 9/1949 | Sanders et al. | 446/372 X |
| 2,551,195 | 5/1951 | Wirth | 46/154 |
| 2,619,771 | 12/1952 | Jones | 446/327 |
| 2,729,024 | 1/1956 | Guttmann | 446/327 |
| 3,221,442 | 12/1965 | Estern et al. | 446/327 |
| 3,564,807 | 2/1967 | Brieske | 446/327 X |
| 4,531,925 | 7/1985 | Moreau | 446/369 |
| 4,601,670 | 7/1986 | Williams | 446/327 |

*Primary Examiner*—Philip C. Kannan

*Attorney, Agent, or Firm*—Gifford, Groh, VanOphem, Sheridan, Sprinkle and Dolgorukov

[57] ABSTRACT

A soft-bodied puppet doll includes a stuffed body, a stuffed head affixed to the body, stuffed arms and legs affixed to the body, and sleeves disposed about the arms and affixed to the body. The body, sleeves and head possess interior surfaces, and said arms possess exterior surfaces, such that said surfaces together define a substantially continuous cavity within said body, dimensioned to receive the hand of a wearer therein. The puppet doll is free of any rigid reinforcement; rather, the stuffing of the elements of the doll provide the rigidity necessary for maintenance of the shape of the doll during use. The body of the doll is constructed from a stuffed body front and a stuffed body back affixed to each other along most of their side and top edges, except for neck and arm openings. The sleeves are connected to each of the front and back body halves at the arm openings, while the arms are disposed in the sleeves, affixed only to the front body half. The user's hand is completely concealed from view, even in silhouette, when viewed from the front of the doll, since the stuffed arms are disposed in front of the wearer's thumb or fingers. The head of the doll includes a fabric neck formed continuously with the fabric of the doll head, but inwardly upturned inside the head. The upturned neck forms the head portion of the cavity. Methods for constructing the doll and forming facial and other features on the surface of the doll are also disclosed.

13 Claims, 13 Drawing Figures

PUPPET OR DOLL HAVING STRUCTURE PROVIDED BY STUFFING

BACKGROUND OF THE INVENTION

I. Field of the Invention

The present invention relates to sewn and stuffed fabric objects, and more particularly to a stuffed doll or puppet.

II. Description of the Prior Art

Dolls and puppets are works of art which have likely existed since prehistoric times. Dolls and puppets can generally be described as realistic or miniature fanciful representations of actual or imaginary people. A primary distinction between dolls and puppets is that the latter is usually considered to be manipulable, by hand or otherwise, and thereby provide an additional avenue for gratification or entertainment.

A common type of doll is constructed from one or more pieces of fabric which are joined together by sewing along the edges thereof, forming pockets into which a stuffing material is introduced. In structural contrast, hand puppets generally first comprise a piece of cloth draped over the hand of a user, representing the body of the figure. The fingers of the user are generally either encased by cloth so as to represent the arms and head of the figure, or engage rigid members affixed to the portions of the puppet corresponding to the head and arms.

Prior attempts to combine these features into an object which functions both as a doll and as a hand puppet have encountered some drawbacks. The use of reinforcement in a stuffed puppet doll, to provide structure to the bodies and a place for reception of the user's fingers, increases the weight of the puppet doll, and unduly restricts movement of the user's fingers. Laundering of such a puppet doll is not advisable, since the reinforcement may shift, or change the position of the stuffing of the doll, and detract from the appearance and utility of the puppet doll. Further, the reinforcing members can be a source of injury to a child, through swallowing, laceration from sharp or broken edges, or the like. Additionally, the provision of rigid portions in a puppet doll increases the cost and time necessary to manufacture such a doll. When such reinforcement is not provided, the outline of the user's hand is quite visible, since the cloth is merely draped over the hand.

SUMMARY OF THE INVENTION

The present invention overcomes these and other drawbacks by providing a soft bodied puppet doll having no rigid reinforcement, other than the rigidity provided by the stuffing in the doll, yet which also retains good flexibility while substantially obscuring the outline of the manipulating hand. The puppet doll according to the present invention first comprises a pair of stuffed body panels between which the hand of the user is sandwiched. The puppet doll also includes stuffed arms and legs which are affixed to only one of these body panels, specifically, that body panel comprising the front of the doll. The arms of the doll are encased in sleeves affixed to both the front and back body panels.

The puppet doll also includes a stuffed head having a cavity for the fingers formed therein. The cavity is formed by the fabric of the head, from an upwardly turned tapered neck received in a recess in the stuffing inside the head. Thus, a continuous cavity is formed in the body, sleeves and head for receiving the hand of the user therein, without requiring reinforcement of the body parts and head by rigid tubes, wires or the like. In use, the hand is slid between the body panels and the thumb and fingers are slid into the sleeves behind the arms, so that the outline of the hand is not seen through the body pieces.

Because the body and head of the doll are stuffed, the puppet doll also serves the function of a conventional stuffed doll, but has a storage space therein defined by the hand-receiving cavity. The cavity permits the doll to alternatively function as a hand warmer, when the fabric of the doll and the stuffing are selected so as to provide thermal insulation against the cold. The doll is preferably constructed from launderable materials, so as to facilitate cleaning, and the absence of rigid members ensures that any bunching of stuffing that occurs during laundering can be easily remedied after drying.

The present invention also includes a method for constructing the doll described above. The order and nature of certain construction steps decrease the time it takes to construct the doll, also an improvement over the prior puppets and dolls. Lastly, the invention includes the particular methods of sculpting the doll features, such as providing portions representing fingers, toes, the nose, and dimples at the knees, cheeks and mouth.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF THE PREFERRED EMBODIMENT OF THE PRESENT INVENTION

Figure 1:
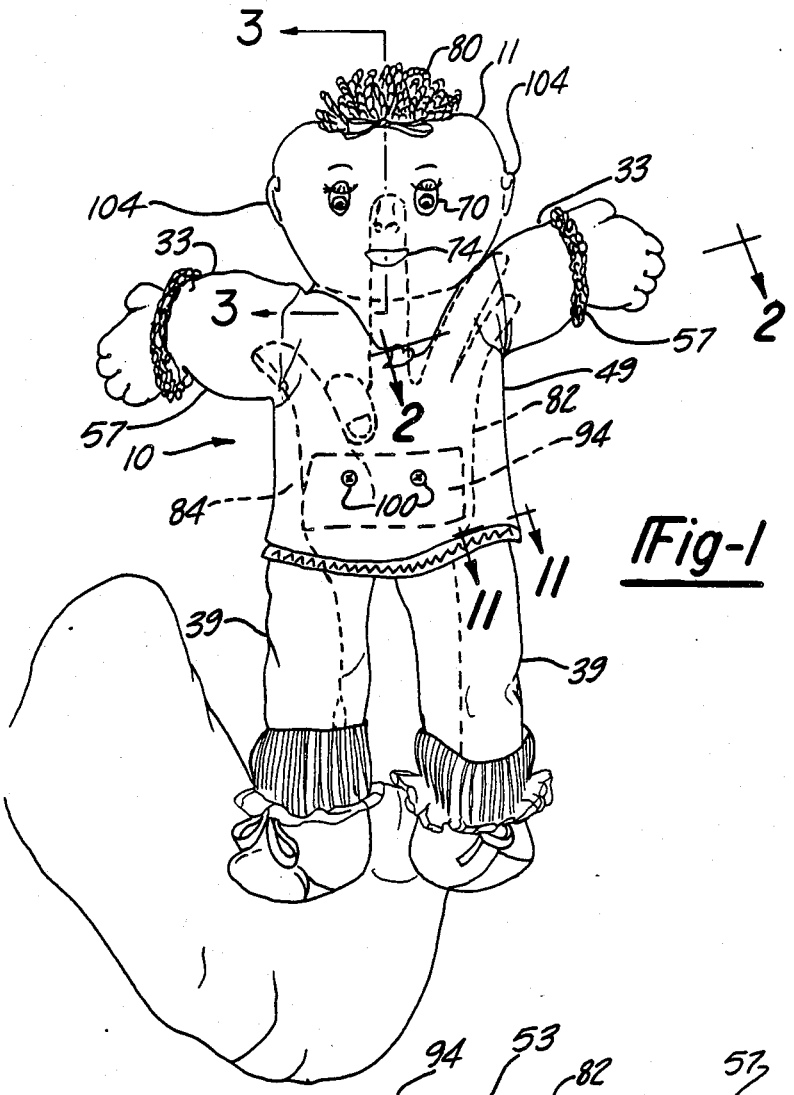
FIG. 1 is a perspective view of the preferred embodiment of the present invention.

The best understanding of the construction of the doll 10 according to the present invention, as shown in FIG. 1, will be had by an appreciation of the way in which the doll is constructed. The doll 10 is assembled by sewing together and stuffing a plurality of fabric pieces to form stuffed body parts, which are then assembled together into the doll 10. The particular embodiment of the doll 10 disclosed and described herein is a fanciful representation of a human infant, although dolls representing older children, teenagers and glamour figures or models can also be constructed by the addition of appropriate clothing.

Construction of the doll 10 is initiated by selecting a first fabric corresponding to the skin portions of the doll, such as the face, arms and legs; and a second fabric for the sleeves and dress (or body). The recommended fabric for the skin is a beige, pink, tan or brown doubleknit polyester, having a straight grain and a moderate degree of stretch perpendicular to the grain. Both fabrics are preferably machine washable. As with most fabrics, the fabric pieces to be cut should have evident or designated right and wrong faces, that is, faces which are intended to be exposed or hidden, respectively, upon completion of the doll. The preferred stuffing for the doll pieces is a synthetic material known as "Polyfil", although any innocuous stuffing material can be used which is sufficiently durable to maintain the shape of the puppet doll during use. The fabric pieces, particularly those corresponding to the skin of the doll, are sewn together with thread which closely matches the color of the fabric.

Figure 4:
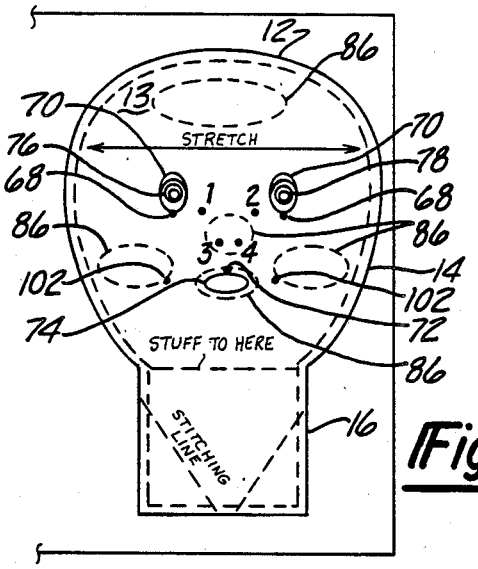
FIG. 4 is a front plan view of a portion of the preferred embodiment of the present invention.
Figure 5:
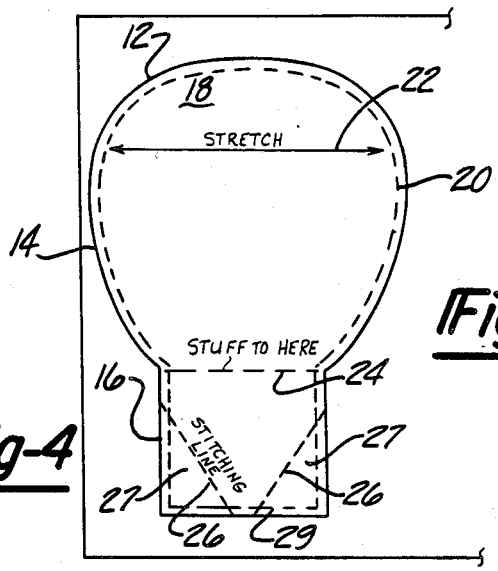
FIG. 5 is a rear plan view corresponding to the view shown in FIG. 4.

The head 11 of the puppet doll is constructed first. A pattern 12 for the head of the puppet doll is shown in FIGS. 4 and 5 and comprises a head portion 14 and a neck portion 16. The head portion 14 of the pattern 12 is about five and one-fourth inches wide and about five and one-fourth inches long. The neck portion 16 of the pattern 12 is about three inches wide and about three and one-fourth inches long. Thus, the pattern piece 12 is about eight and one-half inches in overall length. A front face 13 of the pattern piece 12 is shown in FIG. 4 and includes indicia for the positions of the eyes, to be applied later by nail polish or other material; the mouth, to be applied by similar materials; and a plurality of dots, for sculpturing the features of the face. A rear face 18 of the pattern piece 12 (FIG. 5) includes the stitching borderline 20, a two-headed arrow 22 indicating the stretch of the fabric, a stuffing line 24, and a pair of stitching lines 26 which will serve to define the finger-receiving cavity in the head.

The head 11 is constructed by first cutting two fabric pieces shaped the same as the pattern piece 12. The pieces so cut are pinned together with their right sides facing one another, and are stitched together along the stitching line 20 one-quarter inch from the periphery of the pieces. A very small stitch is used, starting at the corner of the neck and going all the way around the lateral periphery of pattern piece, but leaving the bottom of the neck open. The pieces are then unpinned and turned right side out for stuffing. The head 11 is stuffed firmly to the stuffing line 24, and manually worked until the head forms a firm round ball. A small amount of extra stuffing is then added at the forehead, cheeks, mouth and nose, between the fabric piece and the previously worked, firm stuffing, generally in the locations indicated at ovals 86. This augments the formation of facial features, and in particular results in the formation of a firmer nose, as will be described subsequently.

Figure 10:
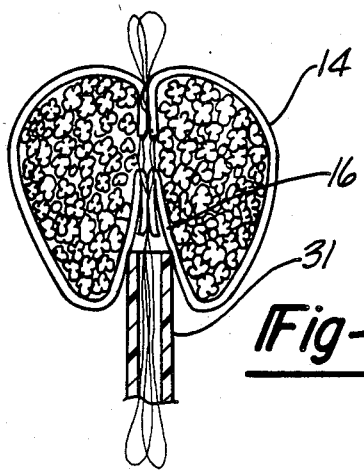
FIG. 10 is a cross-sectional view similar to FIG. 3.

Once the head is stuffed, the maker uses a finger to poke a hole in the center of the stuffing to permit the neck to be pushed up into the head and form a finger-receiving cavity 28. A one-fourth inch seam is first sewn at the bottom edge of the neck opening, at stitching line 29. Diagonally upwards from approximately the center of the neck, a pair of seams are sewn so as to form a V-shape, along the stitching lines 26. The corners 27 isolated by the stitching are cut off. The neck portion 16 is then pushed upwards into the head in the hole poked earlier. The neck portion 16 should be pushed into the head as far as possible manually. A one inch by two and one-half inch smooth hair roller 31 (FIG. 10) is then worked up into the pocket so formed, in order to keep the cavity open for shaping the head into a heart shape.

In order to give the doll 10 a heart-shaped head, the maker measures one and one-half yards of bonded nylon thread of the same or similar tone as the fabric for the skin, doubles it over, threads it to a five inch sculpturing needle, and knots its end. Starting at the top of the head, at its middle, the maker pushes the needle down through the fabric and stuffing, and into the recess in the interior of the hair roller 31. The needle is then reinserted into the fabric of the neck immediately adjacent the first stitch, through the stuffing and out through the fabric of the top of the head. At no time is the thread looped about the hair roller. The thread is pulled tight, and then 4 or 5 more additional stitches are made, first through the top of the head to the interior of the neck, and back upwards again, pulled tight each time, until the head achieves an overall heart shape. Ending at the top of the head, the thread is knotted about 2 inches from the top of the head, and cut. The roller 31 is removed from the cavity 28, and the head 11 is set aside for later attachment to the body.

Figure 6:
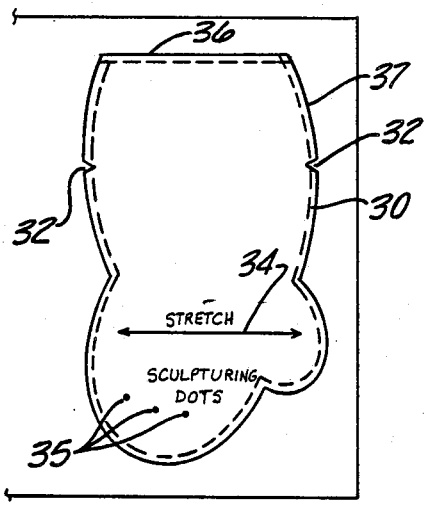
FIG. 6 is a plan view of a preferred embodiment of the present invention.

The next portions of the doll to be assembled are a pair of arms 33. The pattern piece 37 for the arms 33 is shown in FIG. 6 and includes a quarter inch seam line 30 and a pair of notches 32 indicating a stuffing line. An arrow 34 indicates the direction of stretch of the fabric, and three sculpturing dots 35 are provided to indicate where the fingers of the doll will be formed. The pattern piece 37 is about five inches long and about two and three-eighths inches wide at its base, opposite the thumb and fingers. It is about two and seven-eighths inches wide across the widest part of the palm and thumb.

Four pieces of skin material are cut using the arm pattern 37, the pieces for each of the arms being cut as mirror images to one another. For each arm, two mirror image fabric pieces are pinned right sides together, and stitched together along the seam line 30 with a one-fourth inch seam, a top end 36 being left open for stuffing. Each arm is then turned right side out, the maker taking care to work the thumb portions outwardly. The top opening 36 is turned outwards and down, a little more than an inch, to the stuffing line defined by the notches 32. The arms are stuffed firmly to the top. The material that was turned down is then flipped up, and the opening stitched closed with a one-fourth inch seam. The stuffing is left packed down for easier attachment of the arms 33 to the body.

Figure 7:
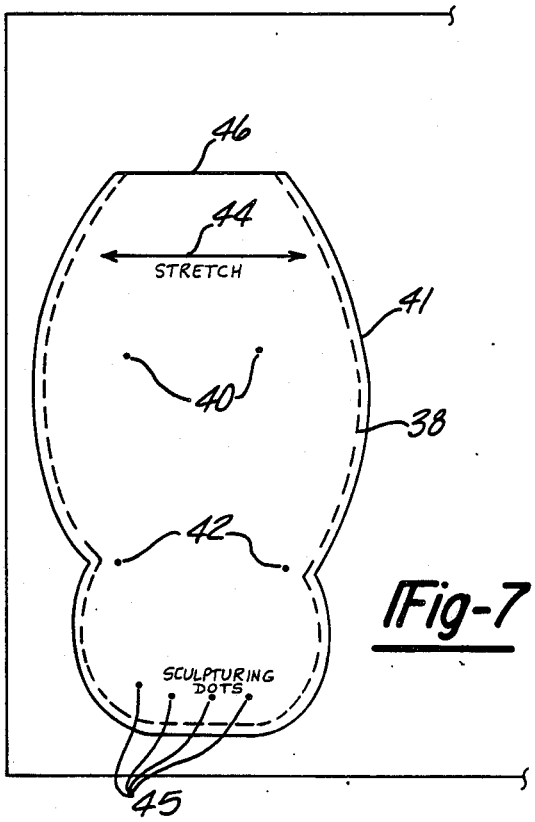
FIG. 7 is a plan view of a portion of the preferred embodiment of the present invention.

The next parts of the doll formed are a pair of legs 39. The pattern for the legs is shown in FIG. 7 and comprises a pattern piece 41 including a one-fourth inch seam line 38, a plurality of dots 40, 42 and 45 for sculpturing the knees, ankle and toes, respectively, and an arrow 44 indicating the stretch of the fabric. The leg pattern piece is about six and one-half inches long, about three and one-half inches wide at its widest part, and about one and five-eights inches wide at its top 46.

Four pieces of skin fabric are cut conforming to the outline of the leg pattern piece. Two pieces for each leg are pinned right sides together, and the pieces are stitched together along the seam line 38, preferably with a small machine stitch. The top end 46 is left open for stuffing. After stitching, the pieces are unpinned and turned right side out. Stuffing is then introduced through the open top and into the foot and leg. The foot is stuffed firmly, while the remainder of the leg is stuffed loosely, with only a small amount of Poly-fil. The open top of the leg is then sewn shut with a quarter-inch seam parallel to the flat edges of the pieces.

Figure 12:
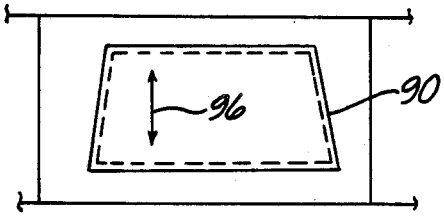
FIG. 12 is a plan view of a portion of the preferred embodiment of the present invention.

The stuffed body 49 of the doll is formed from the garment fabric. Four pieces are cut in conformance with the dress piece pattern 51 shown in FIG. 8. The dress piece pattern 51 includes seam lines 48 indicating a one-eighth inch seam about the arcuate neck opening at the top of the piece, a five-eighth inch seam line 50 about the remainder of the periphery of the piece, and a one-fourth inch seam line (not shown) for reinforcement of the neck opening. The neck opening is formed as a concave circular arc at the top of the piece 51 having a radius of curvature of about one and one-eighth inches. The piece is otherwise a regular trapezoid in shape, having a base about seven and five-eighths inches wide, a top edge about five and one-eighths inches wide, and a height of about seven and one-half inches. A fifth trapezoidal piece is cut in conformance with the dress pocket piece pattern 90 shown in FIG. 12. The piece 90 is about three and one-quarter inches high, has a bottom edge about five and five-eighths inches wide, and has a top edge about four and three-eighths inches wide. The pattern piece 51 also includes positioning and stitching lines 92 for directing attachment of the pocket piece to one of the body pieces. The pattern piece 90 includes an arrow 96 indicating the grain of the fabric.

The four body pieces cut from the pattern piece 51 should be individually identified as being either the inside or outside of the front or back, since two of the pieces will be sewn together to form the body back, and two of the pieces will be sewn together to form the body front. Substantially all of the trim or decoration that the maker desires to place on the outside body front piece should be attached at this time. However, the inside body front piece is marked at a pair of dots 98 for subsequent stitching, as will be described below. On all four pieces the neck opening should be turned down on the right side of the fabric and stitched at the seam line 48 with a small zigzag stitch. The pocket piece 90 is stitched to the right side of the inside back body half piece with a one-fourth inch stitch along three sides, edges turned to the wrong side of the product, leaving the top edge of the pocket 94 so formed open.

A back half 53 of the body 49 is formed by pinning the inside and outside back pieces together, right sides together, and stitching a five-eighths inch seam across the bottom of the pieces. The pieces are unpinned and turned right side out, and then pinned together at the sides and shoulders. The edges of the sides and shoulders are stitched together with a small zigzag stitch. A neck opening is left open for the introduction of stuffing between the pieces.

A front half 55 of the body 49 is formed in a slightly different manner. The remaining two body pieces are pinned together, right side out, care being taken to note that the trim side will be the outward facing front of the body. The sides and shoulders are pinned together, and the edges of the sides and shoulders are stitched together with a small zigzag stitch, leaving a neck opening for stuffing. The bottom is hemmed by turning the bottom edge upwardly and inwardly to the wrong side and sewn with a five-eighths inch seam, all the way around, but not affixing the bottom edges of the pieces together. Rather, the bottom of the front is left open for the attachment of the legs.

The front and back body front pieces are once again pinned at their shoulders, and each is provided with a one-fourth inch seam reinforcing the earlier seam near each of their neck openings. The neck openings must remain open for stuffing.

Figure 9:
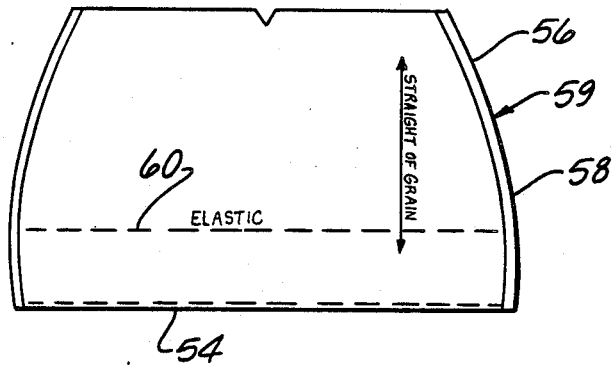
FIG. 9 is a plan view of a portion of the preferred embodiment of the present invention.

A pair of sleeves 57 of the puppet doll are also cut from the dress fabric, from a pattern 59 shown in FIG. 9. Two of the pieces are cut, one for each sleeve. The pattern piece 59 is about five inches wide at its top, about seven and one-fourth inches wide at its bottom, and is about four and one-eighth inches long.

After cutting, a narrow hem (one-sixteenth to one-eighth of an inch) is sewn at a lower edge 54 of the sleeve 57. The right side of the sleeve 57 is folded over itself so as to bring curved edges 56 adjacent and aligned with one another, and a one-fourth inch seam is sewn along line 58. A length of narrow elastic material is affixed above the narrow hem at line 60, and is pulled tight to form a gathering.

Figure 2:
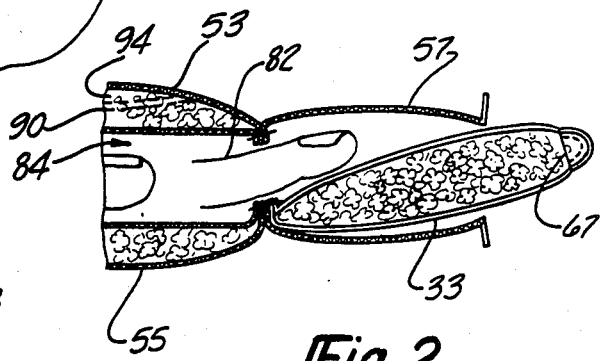
FIG. 2 is a cross-sectional view taken along line 2—2 of FIG. 1.
Figure 3:
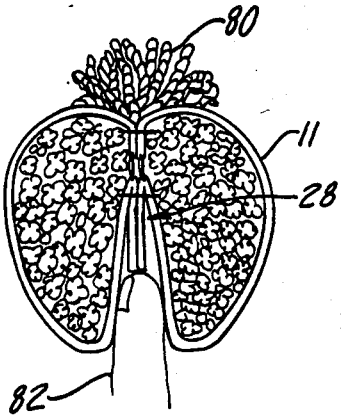
FIG. 3 is a cross-sectional view taken along line 3—3 of FIG. 1.

The arms 33 and sleeves 57 are now affixed to the front and rear dress or body portions, as shown in cross section in FIG. 2. The front 55 and back 53 portions of the dress are pinned right sides together, and one of the sleeves 57 is positioned with its middle aligned with the shoulder seam. The side edge of the front 55 and back 53 of the dress are stitched together up to the sleeve, and then the sleeve 57 is separately stitched to the front and back body pieces, leaving an opening through which the user's finger will later pass. The other sleeve is attached in a similar fashion. The shoulders but not the neck openings of the front and rear body portions are also stitched together at this time.

One of the arms 33, thumb facing upwards, is then placed atop the sleeve, extending outwardly, on the front side of the doll. Starting at the shoulder, the arm is sewn to the front portion 55 of the dress only. The edge of the arm is aligned with the edges of the sleeve 57 and body front 55, and is not pulled down to the outer end of the sleeve. The other arm 33 is sewn to only the front 55 of the dress and the sleeve 57, in the same fashion.

The back 53 of the dress is then unpinned from the front 55 and turned over the front, and repinned. The sleeves 57 are also pinned, and the back 53 is sewn to the front 55 and sleeve 57 using a continuous one-fourth inch seam. The other sleeve 57 is pinned and the back 53 is similarly sewn to the front 55 of the other sleeve 57. The arms 33 are then massaged to work the stuffing evenly through the arm and to the top of the arm. The front 55 and back 53 of the body are then unpinned, as are the sleeves, and the body 49 is turned right side out. The arms 33 are then worked through the sleeves 57 and both the arms 33 and sleeves 57 are brought outside the body 49.

Figure 8:
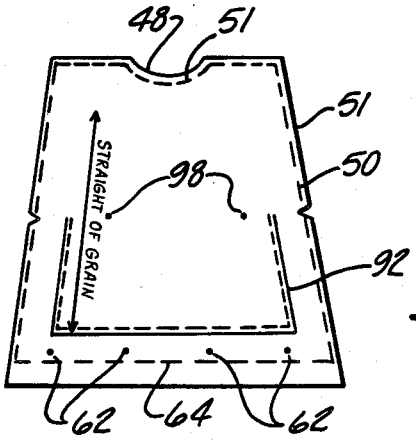
FIG. 8 is a plan view of a portion of the preferred embodiment of the present invention.
Figure 11:
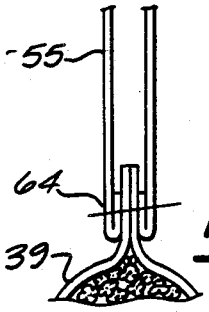
FIG. 11 is a cross-sectional view taken along line 11—11 of FIG. 1 of a portion of the preferred embodiment of the present invention.

The legs 39 are pinned to the interior or back piece of the dress front, and stitched only to the interior front portion, along the edges of the legs, which are positioned at the dots 62 (FIG. 8). Care must be taken to keep the back of the dress away from the front during this stitching. The front or outward piece of the dress front 55 is then brought over the sewn-in legs 39, and the outer and inner front pieces are stitched together along their bottoms (seam line 64). The resulting construction is shown in FIG. 11.

The front 55 and back 53 portions of the body are then stuffed through the neck openings. A relatively small amount of Poly-fil stuffing, about a handful for each of the front and back portions, is introduced into the portions through the neck opening. The stuffing is worked around to fill the body portions, more stuffing being packed at the shoulders than anywhere else. The front 55 and back 53 body portions are then sealed by an overlapping stitch closing each of the neck openings. Care should be taken that too much stuffing is not used in the body pieces 53 and 55, as this will substantially reduce the flexibility of the puppet doll when positioned on the hand. The inner and outer halves of the body front are then stitched together by stitches at the dots 98, through the stuffing. The stitches through the dots 98 can also be used to attach one or more final decorative pieces, such as a ribbon, pom-pom, or a pair of buttons 100 to the body front 55. The stitches 98 primarly serve to keep the stuffing from bunching at the lower end of the body, making the body more attractive.

The head 11 is suffixed to the body pieces 53 and 55 by first aligning the side seams of the head with the shoulder seams. Starting at the front, the head 11 is hand stitched to the body 49 at the neck opening using large stitches, so as to merely initially tack the head to the body 49. The head 11 is then more firmly affixed to the body 49 by sewing with small back stitches beginning and ending at the shoulders. The attaching thread is knotted off.

The face, fingers, knees, ankles and toes of the doll are then sculptured and decorated to give the puppet doll a more natural, lifelike and attractive appearance. First, with a vanishing pencil, a plurality of dots for the nose, nostrils, mouth and dimples are marked according to the locations shown on the rear of the face pattern piece (FIG. 5). The dots numbered 1 and 2 are positioned level with the center of the face, disposed evenly about three-eighths of an inch either side of the center point. The numbered dots 3 and 4 are centered about one-half inch below dots 1 and 2, and are spaced about three-eighths of an inch apart.

The nose and nostrils are sculptured by first measuring one and one-half yards of nylon thread corresponding in color to the facial material. The thread is knotted at one end and introduced as a single strand into a three inch sculpturing needle. The needle is first pushed into the head 11 starting at the top of the head 11 in the middle of the head 11 near the seam line, then pushed through the face at dot 1. A small stitch is made, and the needle is then passed inside the head to dot 2. A small stitch is made at dot 2, and the needle is then passed again inside the head back to dot 1. A small stitch is then made and the needle passed interiorly of the head back to dot 2. The thread is then pulled sufficiently tight, but not too tight, so as to give the visual impression of a pinched nose on the face. The needle is then passed inside the head from dot 2 to dot 3, whereat a small stitch is made. The needle is then passed inside the head to dot 2 and pulled, a small stitch made, and thereafter passed inside the head to dot 1. A small stitch over the earlier stitches is made, and the needle passed inside the head from dot 1 to dot 4. A small stitch is made at dot 4, and the needle is passed inside the head, returning to dot 1 where the thread is pulled, a small stitch made and the needle passed inside to dot 2. The passes to dots 3 and 4 are repeated, and the thread pulled evenly at dots 1 and 2 so as to form matching nostrils on the previously formed nose. After the last stitch is made at dot 4, the needle is passed inside the head 11 up to the top of the head 11 in the center, and the thread is pulled from the needle but left in place.

Next, the fingers, knees, ankles and toes are sculptured. First, the stuffing is worked evenly in the arms 33, with care taken to ensure that stuffing is worked into the thumb of the arm 33. For the fingers, three dots 66 (shown on the pattern piece in FIG. 6) are marked with a vanishing pencil on the palm side of each of the hands. About one yard of nylon thread is threaded as a single thread in a three inch sculpturing needle, knotted at one end. The three sculpturing dots 35 are positioned about one-half inch from the seam of the arm, the first dot about one-half inch from the side seam near the thumb area, and the second and third each spaced one-half inch extending from there. Starting at the back of the hand, the needle is pushed through the fabric at the back of the hand through the stuffing and pushed out of the hand at the first dot. The needle is then brought about the hand and pushed through the hand again and drawn tight, so that a tightened loop of thread 67 (as shown in FIG. 2) is formed disposed approximately perpendicularly to the seam at the hand, defining abutting sides of two adjacent fingers. The loop is formed a second time, and the needle subsequently passed to the second and third dots, so as to form four separate fingers. After the second loop is made, a small stitch is made on the back of each hand at the point where the threads pierce the hand. After the last loop is formed and stitched, the thread is run inside the arm up to the top, where it joins the body, and the thread is tied off and cut. The toes are formed in a similar fashion, using four dots instead of three, similarly ending at the top of the leg. The knees and ankles are sculptured similarly to the node, by stitches and run up to the top of the leg.

The face is now marked on the head. Using a vanishing pencil, a dot 68 is made one-half inch either side of the stitches forming the bridge of the nose. The eyes are thirteen-sixteenths inch oval shapes 70 centered over these dots, with their bottoms in contact with the dots. Another dot 72 is marked one-half inch below the center of the nose, and a horizontal thirteen-sixteenths inch oval shape mouth 74 is drawn centered beneath but in contact with the dot. A pair of cheek or dimple dots 102 are marked about one inch either side of the dot 72.

All of the coloring for the eyes 70 and mouth 74 is preferably done with nail polish. After the details of the eyes 70 and mouth 74 are drawn in with vanishing pencil, the eyes 70 and mouth 74 are outlined with a permanent brown pen. Eyelashes and eyebrows are similarly marked. The eyes 70 are then colored first with two or more coats of white nail polish, generally requiring one-half hour of drying time after each application. A circle 76 is drawn for the iris of the eye 70, and colored with the desired color, brown, blue, green or the like. Black nail polish is used to make a dot 78 for the pupil in the center of the iris so colored. A toothpick can be dipped in white nail polish and drawn along parts of the eye 70 for highlights. The mouth 74 is filled in with a light shade of pink nail polish and allowed to dry.

The three inch needle is rethreaded with the thread left at the top of the head from forming the nose, in order to form dimples at the cheeks and corners of the mouth 74 and eyes 70. A small stitch is made in the top of the head, and then the needle is drawn inside the head to an exit point just outside the corner of the mouth. The needle is pulled through, a small stitch made just inside the corner of the mouth, through the nail polish, and the needle is then drawn up to the top of the head again. A small sitch is made, and the needle run to the corner of the mouth 74 a second time and redrawn through the top of the head. The thread is pulled, and the corner of the other side of the mouth 74 similarly stitched, keeping the pull about the same so as to maintain symmetry of the face. Care should be taken to avoid introducing the thread between stitches into the cavity 28 in the head 11. Stitches at the outer end inner corners of each eye 70 are formed in a similar manner. The cheek dimples are also formed in a similar fashion, but sewing only once from the top of the head down to each dimple dot 102, back up again, and ending at the top of the head. When the second dimple is formed, a small stitch is made back and forth to tie the thread in place, and the thread cut.

The last step in forming the features of the face of the doll 10 is to pinch the mouth so as to give the appearance of a pair of lips. A curved needle is double threaded with a strong nylon thread and inserted through the fabric of the face at the bottom center of the mouth oval 74, leaving a length of thread outside the head 11. The needle and thread are passed through an adjacent portion of the stuffing and then brought outside the head 11 at the top center of the mouth 74. The thread is tied into a tight loop, so as to crease the mouth 74 on a line between the stitches at its corners. The loop is left in place two or three hours and subsequently cut and removed.

The doll 10 can be provided with a pair of ears 104 if the hair 80 is not intended to cover the sides of the head 11. This is the case with the infant doll 10 of the preferred embodiment of the present invention. Most conveniently, the ears 104 are formed from a pair one inch by one-half inch pieces of face material, which are rolled along their shorter edges and stitched to opposite sides of the head 11. Alternatively, the ears can be formed as stuffed pouches of any desired shape, depending upon the type of figure the doll represents. Such ears can be conveniently attached to the head by sandwiching them between the fabric pieces for the head 11 prior to sewing them together.

The hair 80 for the infant puppet doll is preferably formed from yarn. Generally, about six "curls" of yarn will be sufficient for the infant doll. A curl is formed by wrapping the desired color of yarn transversely around three fingers about ten times. The yarn is hand stitched from the top of the fingers to hold the yarn together, and then removed from the fingers and the loose ends cut free. The stitch ends of the curl are sewn down to the head 11 using a curved needle, starting in the groove of the head 11. Subsequent curls are added in a position so as to hide the other stitches being made.

Attachment of the hair completes the assembly of the preferred embodiment of the puppet doll. So constructed, the puppet doll 10 includes a continuous cavity 84 formed by the spaces between the front and back body portions 53 and 55, between the sleeves 57 and arms 33, and in the head 11. The head, arms and legs are rigidified only by the stuffing therein. Of course, structural modification of the doll, so that it gives different visual impressions, is straightforward during construction. For example, similarly or contrastingly colored clothing can be added, as can other decorations or props.

Operation of the doll as a puppet is straightforward as well. As is shown in FIG. 1, the hand 82 of a user is placed up the middle of the body 49 between the front 55 and back 53 body portions, in a continuous cavity 84 formed therebetween. The thumb is placed in the cavity in one arm, that is, behind the arm 33 and in the sleeve 57. The elastic prevents the thumb from protruding beyond the extent of the sleeve 57, and the elastic provides a fluffiness to the sleeve 57 that further hides the outline of the thumb. The index finger is placed in the cavity 28 formed in the head, which is also in communication with the cavity 84 in the body. The middle or middle and ring fingers are placed in the other sleeve opening, like the thumb, and are also similarly hidden. The little or ring and little fingers are folded into the palm of the hand, behind the stuffed front body portion 55. Most advantageously, the arms 33, body 49 and head 11 are movable independently of one another, but the puppet doll 10 is free of any rigid reinforcement of the head or arms, other than the moderate stiffness provided by the stuffing itself.

The puppet doll of the present invention is very inexpensive to make, and can be assembled in a single day. The puppet doll 10 can be used as either a puppet or a doll, and can be dimensioned in size and configuration so as to suit the needs of an infant, child or teenager. It is preferred that sufficient flexibility exists between the legs and body front portion so that the doll can be made to sit in an upright position by insertion of a support (not shown) into the cavity 84 between the body halves. The support can comprise a twelve inch high and four inch wide styrofoam cone, having the point of the cone disposed inside the head cavity 28, so that the doll 10 stands in an upright position. The support can alternatively comprise a smaller five inch by five inch cone so as to place the doll 10 in a sitting position. In either case, the styrofoam should be covered with a thin plastic wrapping to prevent snagging n the material of the doll. Alternatively, the cavity 84 can be stuffed open with tissue paper.

The puppet doll also can serve as a hand warmer in the winter, when taken outdoors, and when stuffed with a stuffing which provides thermal insulation. The doll is preferably constructed from launderable materials, so that the assembled doll is completely washable. Preferably, during laundering and particularly during drying, the doll is placed in a laundry bag so as to minimize stress on the seams.

Figure 13:
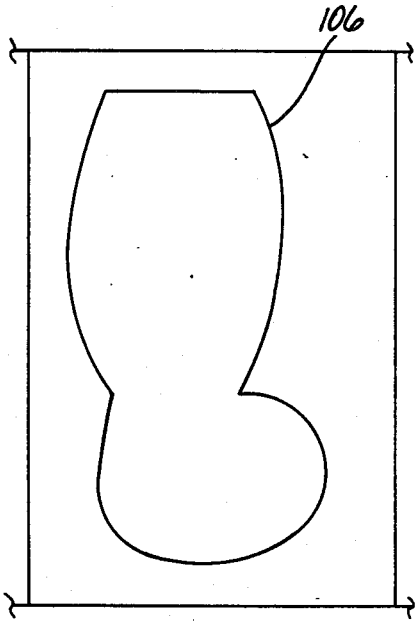
FIG. 13 is a plan view of another preferred embodiment of the present invention, similar to FIG. 7.

When the doll is configured as a teenager or as a replica of a real or an imaginary glamorous or popular figure, care should be taken to note whether the particular decorations or hair employed are launderable. Preferably, when the doll represents a figure older than an infant, the leg is preferably cut from the pattern 106 shown in FIG. 13. In such a case, the seam of the leg (when stuffed) must be centered when the leg is affixed to the rear piece of the body front portion 55. The toes and knees will be sculptured similarly, but disposed transversely to the seam, instead of parallel, as is the case with the infant leg. Since the older doll will be likely to require additional clothing, the leg seams will remain hidden unless such clothing is removed.

The doll 10 according to the present invention is particularly advantageous over other puppet dolls in that it is unusually safe, containing no rigid reinforcements or plastic parts which might injure a child. This is of particular concern for dolls given to children, who can take the dolls of the present invention to bed, or can wear them or carry them as purses, employing the concealed pocket 94, without risk. The doll is also lightweight in construction, since rigid reinforcements are eliminated.

Having thus described my invention, however, many modifications thereto will become apparent to those skilled in the art to which it pertains, without deviation from the spirit of the present invention as defined by the scope of the appended claims.

I claim:

1. A method for assembling a stuffed, soft-bodied doll having interior head, sleeve and body surfaces defining therebetween a continuous cavity in said doll, said cavity being dimensioned to receive a wearer's hand therein; wherein said doll is free of any rigid reinforcement, such that maintenance of the shape of said doll is provided only by the stuffing therein; said method comprising:

(a) constructing and stuffing a cavitied head, a pair of arms, a pair of legs, and constructing a pair of sleeves;

(b) constructing a body front half and a correspondingly dimensioned body rear half, each possessing a first side ultimately facing outwards from the assembled doll and a second side ultimately facing inwards towards the other body half;

(c) affixing said front and rear body halves together with said second sides adjacent one another, so as to join portions of the top and side edges of said body halves and leave openings for attachment of said head and said pair of sleeves;

(d) affixing said pair of sleeves inside-out to said front and rear body halves at said sleeve openings;

(e) affixing said arms to only said front body half at said sleeve openings;

(f) passing said arms through said sleeves and turning said body halves first side out so as to dispose said body half second sides adjacent one another, dispose said sleeves right side out, and dispose said arms in said sleeves;

(g) affixing said pair of legs to said front body half opposite said neck opening; and (h) affixing said head to said body halves at said neck opening, so as to close said neck opening.

2. The invention according to claim 1, wherein digits are formed on said ends of the arms or legs by forming a loop of thread through a portion of said arm or leg, tautening said thread so as to form a constrictive loop longitudinally aligned with said arm or leg, and tying off said thread.

3. The invention according to claim 1, wherein said method further comprises constructing said head by stuffing an oval, open-necked fabric bag, forming a cavity in the stuffing in said bag coaxial with the neck of said bag, sewing said neck shut, stuffing said neck inside said stuffing cavity so as to form a recess in said head, connecting a thread to the crown of said head and the apex of said neck, and drawing said thread so as to cause resilient compression of said stuffing in said head.

4. The invention according to claim 1, wherein said method involves constructing said doll from a body front half comprising front and rear body front half pieces having joinable lower edges, said method comprising the additional steps of affixing said body front half pieces to said body rear half prior to affixing said lower edges of said front body half pieces to one another, affixing said stuffed legs to said rear body front half piece, and subsequently affixing said front body front half piece to said rear body front half piece and said legs.

5. The invention according to claim 4, wherein said front and rear body halves are hollow and include an opening for the introduction of stuffing into said body halves, and wherein said method additionally comprises the step of introducing stuffing into said front and rear hollow body halves prior to affixing said head and said body halves.

6. The invention according to claim 1, wherein facial features are formed on said head by making small stitches on the surface of the head, joining said stitches by strands, and tensioning said strands so as to form said facial features.

7. The invention according to claim 2, wherein said method further comprises the steps of positioning four stitches on the face of said head in a trapezoidal shape and running a thread from each stitch to the top of said head.

8. The invention according to claim 7, wherein the making of said stitches and the drawing of said threads is carried out by sequentially forming said stitches and said strands from a single continuous and unbroken thread.

9. A somewhat flexible, soft-bodied doll having a body, a head affixed to said body, a pair of arms affixed to said body, a sleeve enclosing each of said arms, and a pair of legs affixed to said body; said body, head and sleeves possessing interior surfaces, and said arms possessing exterior surfaces, which surfaces together define a substantially continuous cavity in said doll, said cavity being dimensioned to receive the hand of a wearer therein; such that said head, arms and legs are rigidified solely by stuffing therein; and wherein the portions of said cavity defined by said arms and sleeves are disposed posteriorly of said arms.

10. The invention according to claim 9, wherein said doll comprises a stuffed body front and a stuffed body back, each of said front and back having top, side and bottom edges; said back being affixed to said stuffed body front along a lower extent of their sides and an outer extent of their tops, so as to define neck and arm openings therethrough; wherein said sleeves are affixed to said stuffed body front and body back at said arm holes; wherein said stuffed arms are affixed only to said body front and a front portion of said sleeves, said arms being disposed in said sleeves; and wherein said stuffed legs are affixed to said body front.

11. The invention according to claim 10, wherein said stuffed body front comprises a front body piece, a rear body piece affixed thereto, and stuffing disposed between said front and rear body pieces; wherein said legs include flat portions at the tops thereof; and wherein said flat portion of each of said legs is sandwiched between said front and rear body front pieces.

12. The invention according to claim 9, wherein said head comprises a fabric bag having a stuffing material disposed therein, and wherein said head includes an inwardly turned upwardly depending neck portion extending into said stuffing, the fabric of said neck defining said interior surface of said head.

13. The invention according to claim 9, wherein a pocket is carried on said interior surface of said body.

* * * * *